US005791894A

United States Patent [19]

Döbbeling et al.

[11] Patent Number: 5,791,894

[45] Date of Patent: Aug. 11, 1998

[54] PREMIX BURNER

[75] Inventors: Klaus Döbbeling, Windisch; Adnan Eroglu, Untersiggenthal; Hans Peter Knöpfel, Besenbüren; Wolfgang Polifke, Windisch, all of Switzerland; Dieter Winkler, Lauchringen, Germany

[73] Assignee: ABB Research Ltd., Zurich, Switzerland

[21] Appl. No.: 747,569

[22] Filed: Nov. 12, 1996

[30] Foreign Application Priority Data

Dec. 2, 1995 [DE] Germany ..... 195 45 026.4

[51] Int. Cl.[6] ..... F23D 14/46

[52] U.S. Cl. ..... 431/350; 431/351; 431/353

[58] Field of Search ..... 431/350, 351, 431/354, 8, 10, 182, 183, 185, 353

[56] References Cited

U.S. PATENT DOCUMENTS 5,433,596 7/1995 Dobbeling et al. ..... 431/351

FOREIGN PATENT DOCUMENTS

| | | |
|---|---|---|
| 413283 | 5/1925 | Germany . |
| 1-302015A | 12/1989 | Japan . |
| 2-21118A | 1/1990 | Japan . |
| WO 93/17279 | 9/1993 | WIPO . |

*Primary Examiner*—James C. Yeung

*Attorney, Agent, or Firm*—Burns, Doane, Swecker & Mathis, L.L.P.

[57] ABSTRACT

In a premix burner having a swirl-stabilizing interior space (20) which is essentially formed by sectional shells (11, 12) nested one inside the other in a mutually offset manner as well as by a conically running inner body (13), one feed duct (11*c*, 12*c*) each extends upstream of the tangential air-inlet slots (11*a*, 12*a*) formed by the offset sectional shells, which feed duct (11*c*, 12*c*) is fitted at least with means (11*d*, 12*d*) for swirling an air flow (23) and with means for introducing a fuel (24). The introduction of the fuel is preferably arranged downstream of the means for swirling the air flow.

13 Claims, 4 Drawing Sheets

PREMIX BURNER

BACKGROUND OF THE INVENTION

1. Field of the Invention

The present invention relates to a premix burner.

2. Discussion of Background

Lean premixed combustion is a widespread method of achieving low pollutant emissions, in particular nitrogen-oxide emissions, during the combustion of fuels having a low content of nitrogen compounds. It has been disclosed by publications that a further reduction in the nitrogen-oxide emissions, in particular during combustion under high pressure, as is the case in gas turbines, is possible using experimental burners by improving the mixing quality of air and fuel. However, transferring such experimental burners to machine technology is not readily possible, since there are stringent requirements with regard to flame stabilization and flashback safety. Conventional swirl-stabilized premix burners suitable for machines do not mix the fuel into the combustion air until just before the flame zone. Tests of burners of the type have shown that homogeneous mixing of air and fuel at the flame zone still cannot be achieved. Shifting the fuel injection upstream to prolong the mixing time and thus improve the mixing quality is not permitted on account of the flashback risk associated therewith in a burner suitable for machines.

WO 93/17279 disclosed a burner which essentially comprises a cylindrical chamber which in turn has a plurality of tangentially arranged slots through which the combustion air flows into the interior of the chamber. In the region of these slots, at the transition to the interior space of the chamber, a number of fuel inject nozzles a gaseous fuel the combustion air flowing through there. Furthermore, the interior space of the chamber is provided with a conical body which tapers in the direction of flow, and additional fuel nozzles for a preferably liquid fuel are provided the tip region of this conical body. The combustion air is ignited downstream of the conical tip of this body. In order to keep the flame stable outside the premix section of the burner, the flow in the chamber itself must be subcritical, i.e. the swirl coefficient must be so small that no vortex breakdown occurs. The critical swirl coefficient can be achieved by three parameters at the correct location: by changing the width of the tangential slots, by adaptation of the angle of the conical body in the interior space of the chamber and by the addition of central assisting air, whether swirled or without swirl. However, due to the fuel injection in the region of the slots, the slots are greatly restricted in their design. In addition, optimum homogeneous mixing of air and fuel cannot be achieved directly. This applies in particular to those fuel injections which are located at the end of the burner and which are accordingly located in the immediate region of the plane of the flame front. What is more there is a potential risk of flashback due to this proximity.

SUMMARY OF THE INVENTION

Accordingly, one object of the invention as defined in the claims, is to improve the mixing quality in a premix burner of the type mentioned at the beginning, and a further object is to eliminate the risk of flashback during the entire operation.

The essential advantage of the invention may be seen in the fact that the improvement can be used in all swirl-stabilized premix burners. The invention is particularly adventageous in premix burners which function with a critical swirl coefficient for forming a backflow zone, and which are constructed according to the principle of two or more offset sectional shells, the offset sectional shells forming air-inflow slots which run parallel to the burner axis.

The same also applies to those burners in which the outer shell comprises a uniform body in the form of a tube and the air flow into the interior takes place through a number of tangentially arranged ducts.

Advantageous and expedient developments of the achievement of the object according to the invention are defined in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
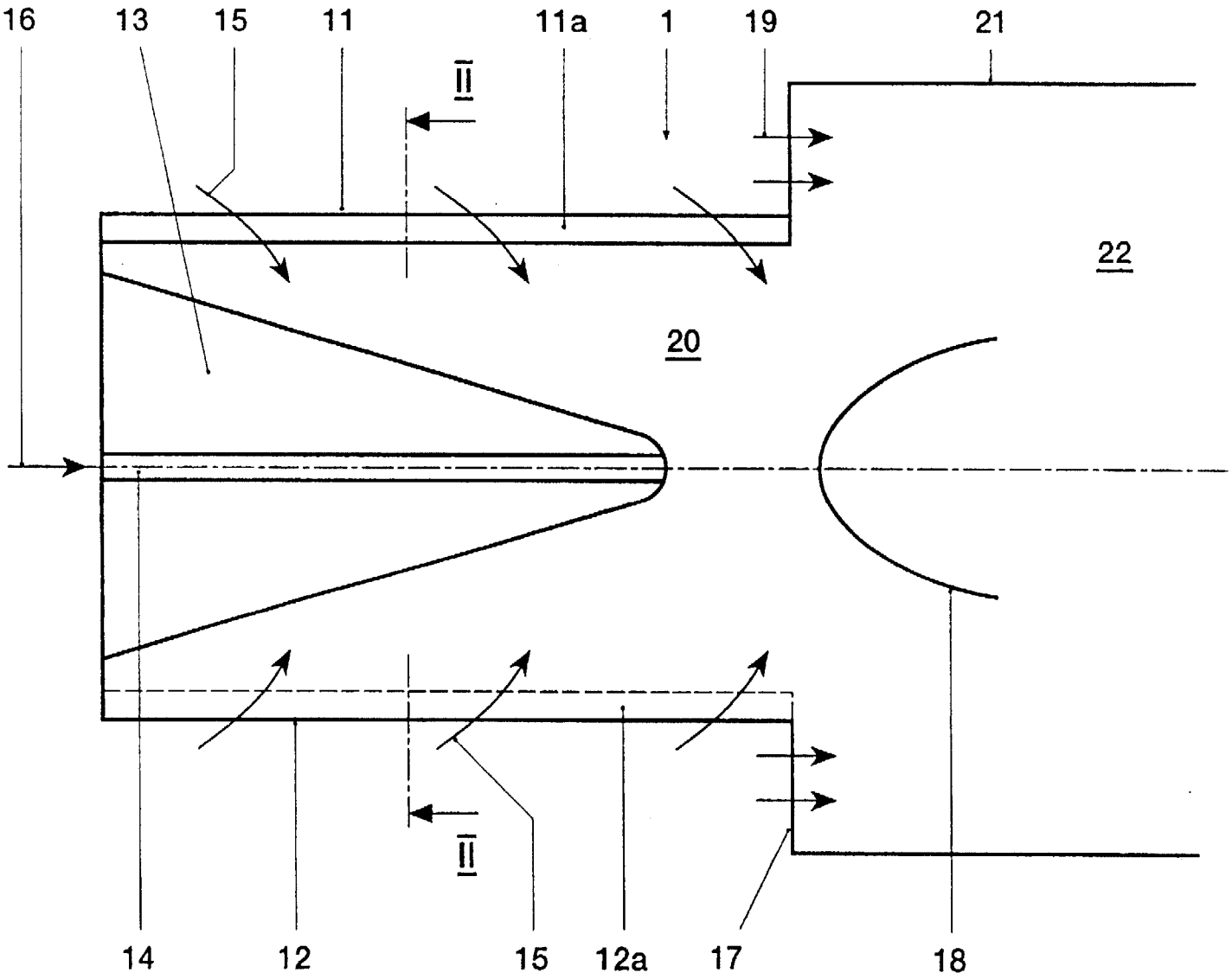
FIG. 1 shows a schematic representation of a premix burner having offset sectional shells and a conical inner body.
Figure 2:
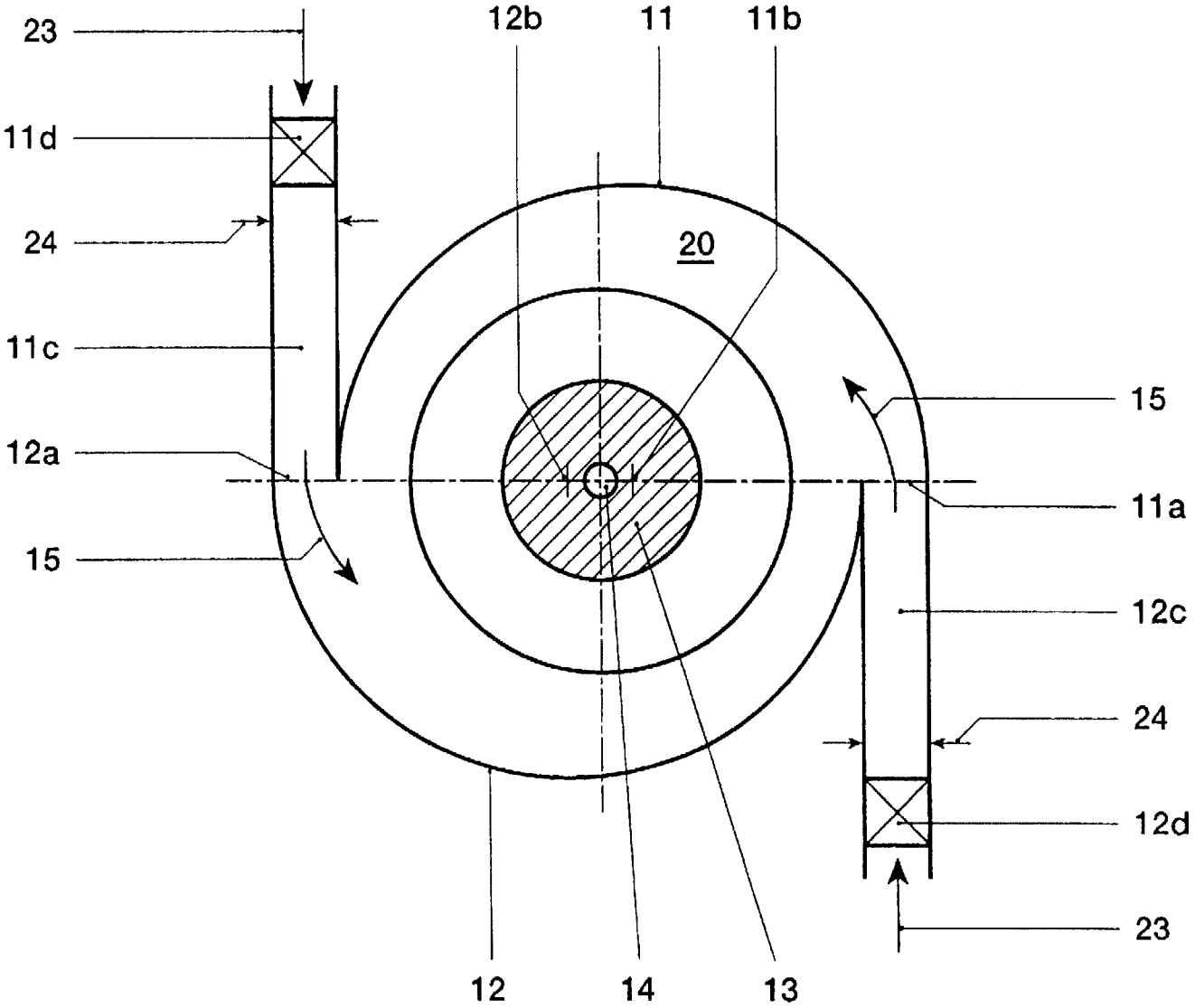
FIG. 2 shows a section through the premix burner along plane II—II from FIG. 1, the premix burner having extending ducts with vortex generators upstream of the air-inlet slots.
Figure 3:
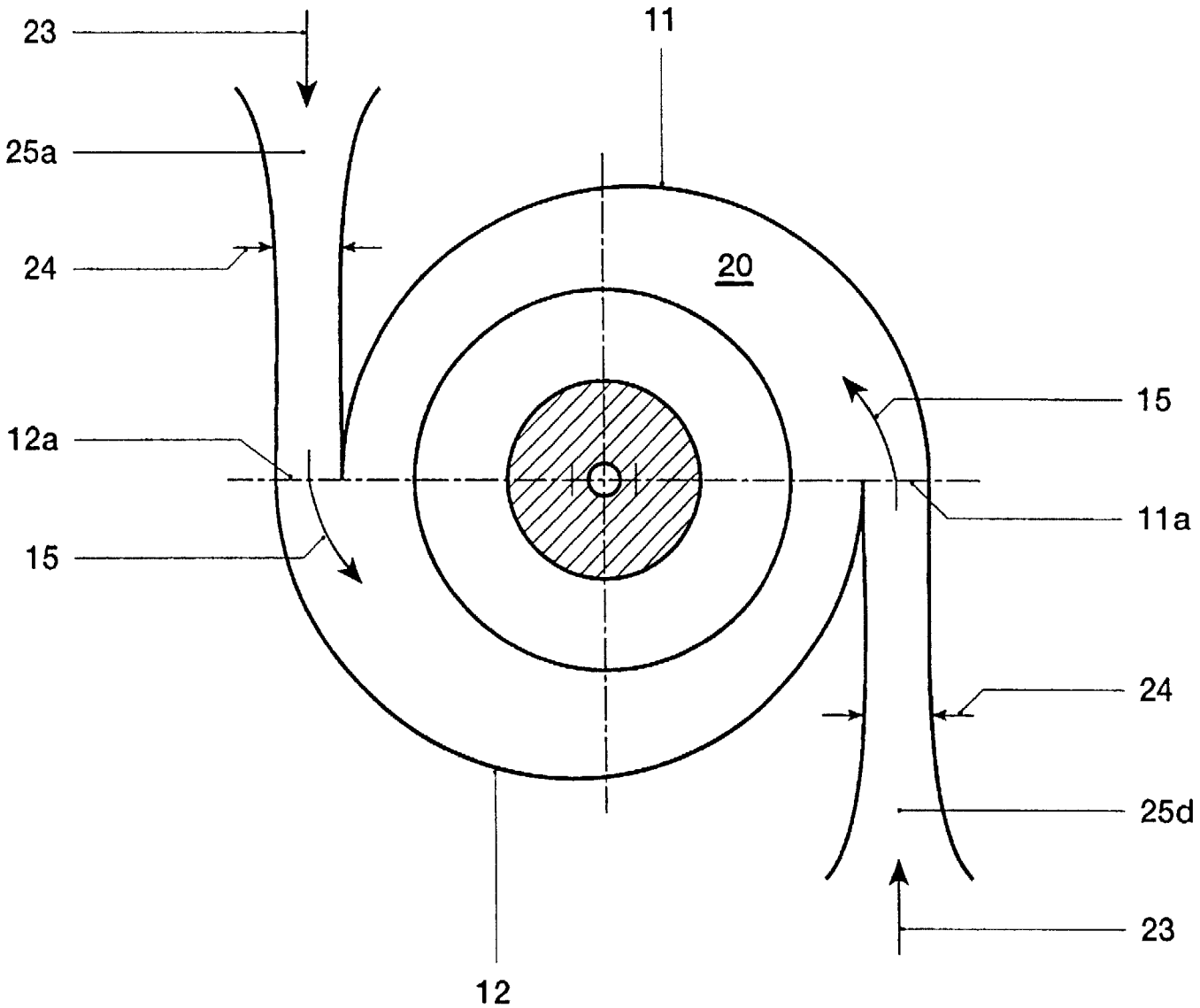
FIG. 3 shows a further representation according to FIG. 2, the extending ducts being equipped with a venturi mixer.

Referring now to the drawings, wherein like reference numerals designate identical or corresponding parts throughout the several views, all elements not essential for directly understanding the invention have been omitted, and the direction of flow of the media is designated by arrows. It is of advantage if FIG. 2 or FIG. 3 is also used at the same time as FIG. 1 in order to understand the construction of the premix burner 1 better. Furthermore, so that FIG. 1 is not made unnecessarily complex, the feed ducts 11*c* and 12*c* according to FIG. 2 or FIG. 3 have not been shown in any more detail. In the description of FIG. 1 below, the other FIGS. 2 and 3 are referred to when required.

The premix burner according to FIG. 1 comprises two hollow sectional shells 11, 12 which are nested one inside the other in a mutually offset manner (cf. FIG. 2 for this). The shells 11, 12 enclose an interior space 20. The mutual offset of the respective center axis or longitudinal symmetry axis 11*b*, 12*b* (cf. FIG. 2) provides on both sides of the interior space 20, in mirror-image arrangement, tangential air-inlet slot 11*a*, 12*a* through which a combustion mixture 15 flows into the interior space 20. The configuration of these air-inlet slots 11*a*, 12*a* will be dealt with in more detail below. The shells 11, 12 run cylindrically in the direction of flow. However, the cross-section of flow formed by the interior space 20 may be designed to decrease or increase regularly or irregularly in the direction of flow, depending on use. A cross-section of flow of the interior space 20 may be shaped as a venturi tube in the direction of flow example. The possible constructions referred to are not shown in any more detail, since they can readily be envisaged by a person skilled in the art. Arranged in the interior space 20 is a conical inner body 13, which tapers in the direction of flow. The body 13 extends well into the interior space 20 and ends in the form of a point. The conical configuration of this inner body 13 is not restricted to the shape represented: an outer shape of this inner body 13 as diffuser or confuser is also possible. At least one bore 14 through which preferably a liquid fuel 16 is directed into the front region passes through the inner body 13. The injection of the liquid fuel 16 in the region of the tip of the inner body 13 forms the head stage of the premix burner 1. In this region, the inner body 13 can readily be supplemented by a swirl generator (not shown in the figure) which assists the mixing of the injected fuel 16. At the combustion space 22, the cross-section of flow area undergoes a jump in cross-section via a front wall 17, which connect the shell 11, 12 to the flame tube 21. The backflow zone or backflow bubble 18 which induces the flame stabilization also forms in this plane. The front wall 17 itself has a pluarlity of bores through which diluent air or cold air 19 is fed to the front region of the combustion space 22 according to requirements. The flame stabilization becomes important in assisting the compactness of the flame as a result of radial flattening, a factor which is also important with regard to the fuel injection through the head stage. The combustion mixture 15 comprises air and fuel (cf. FIG. 2). Of course, the combustion mixture 15 may also contain portions of a recycled exhaust gas or a quantity of steam. It is generally the case that a fluidic marginal zone forms inside the jump in crosssection in the region of the front wall 17. In the marginal zone, vortex separations occur due to the vacuum prevailing there, which vortex separations then in turn assist the flame stabilization. Depending on the degree of assistance, the diluent air or cold air 19 already mentioned is admixed. Swirling of the medium around the inner body 13 develops due to the combustion mixture 15 flowing tangentially into the interior space 20. Vortex breakdown forms in the region of the plane of the front wall 17 on account of the subcritical swirl flow there, homogeneous fuel concentration depending on the design of the tangential air-inlet slots or on the installation of vortex generators in the region of the air-inlet slots. Ignition is effected at the tip of the backflow zone 18: only at this location can a stable flame front develop. A flashback of the flame into the interior space 20 of the premix burner 1, as is always potentially the case in the premix sections which have been disclosed, where a remedy is attempted with complicated flame retention baffles, need not be feared here for the reasons mentioned. If the combustion air is additionally preheated or enriched with one of the media mentioned, this assists the evaporation of the liquid fuel 16 fed through the inner body 13. Narrow limits are to be adhered to in the design of the inner body 13 with regard to the conical configuration and the width of the tangential air-inlet slots 11*a*, 12*a* so that the desired flow field, i.e. the critical swirl coefficient, of the combustion mixture 15 can arise at the outlet of the interior space 20. In general it may be said that a reduction in the cross-section of flow of the tangential air-inlet slots 11*a*, 12*a* displaces the backflow zone 18 further upstream, as a result of which the mixture then ignites earlier, which in this case may give rise to the risk of a collision with the tip of the inner body 13 if the latter extends too far into the interior space 20. Nonetheless, it may be stated that the backflow zone 18, once fixed, is positionally stable per se, for the swirl coefficient increases in the direction of flow in the region of the conical shape of the inner body 13. The cross-section of flow of the tangential air-inlet slots 11*a*, 12*a* may of course be designed to be variable in the direction of flow, for example to decrease in the direction of flow, in order to make the backflow zone 18 more stable at the outlet of the interior space 20. The axial velocity of the combustion mixture 15 inside the interior space 20 of the premix burner 1 can be changed by feeding (not shown in any more detail) an axial combustion-air flow. Furthermore, the construction of the premix burner 1 is especially suitable for changing the size of the tangential air-inlet slots 11*a*, 12*a*, whereby a relatively large operational range can be covered without changing the overall length of the premix burner 1.

FIG. 2 shows the configuration of the sectional shells 11, 12 nested one inside the other. The sectional shells 11, 12 can of course also be displaced relative to one another over this plane, i.e. it is readily possible to effect an overlap of the same in the region of the tangential air-inlet slots 11*a*, 12*a*. Furthermore, it is also possible to nest the sectional shells 11, 12 spirally one inside the other by a contra-rotating movement. It is thus possible to vary the shape and size of the tangential air-inlet slots 11*a*, 12*a* in such a way that the swirl generation in the premix burner 1 can be adapted to the respective conditions. The tangential air-inlet slots 11*a*, 12*a* in each case form the discharge opening of a feed duct 11*c*, 12*c* in which, far removed from the interior space 20, the combustion mixture 15 is formed before it flows into this interior space 20. At an adequate distance upstream of the tangential air-inlet slots 11*a*, 12*a*, the feed ducts 11*c*, 12*c* have vortex generators 11*d*, 12*d* which integrally swirl the air 23 flowing in there. At a suitable distance downstream of these vortex generators 11*d*, 12*d*, a preferably gaseous fuel 24 is injected, whereby the intended air/fuel mixture can then form along the remaining section of the feed ducts 11*c*, 12*c* before this fuel/air mixture flows into the interior space 20 as combustion mixture 15 in an integrally identical consistency over the entire length of the tangential air-inlet slots 11*a*, 12*a*. The feed ducts 11*c*, 12*c* shown here have a largely cylindrical shape, the length and cross-section of flow of which are designed for optimum air/fuel premixing. The flow to be formed inside the feed ducts 11*c*, 12*c* must be set in such a way that no risk of flashback arises from the interior space 20 should instability of the flame front develop. Due to the arrangement shown of the vortex generators 11*d*, 12*d* relative to the fuel injection 24, there is no risk of flashback. The offsetting of the center axes 11*b*, 12*b* has already been dealt with in more detail under FIG. 1.

FIG. 3, unlike FIG. 2, shows feed ducts which have a venturi mixer 25*a*, 25*b* at a suitable distance from the tangential air-inlet slots 11*a*, 12*a*. The fuel injection 24 is carried out at the narrowest location. The greatest velocity also prevails there, whereby the best possible mixture formation is ensured, again while eliminating a risk of flashback. Otherwise, the construction of FIG. 3 corresponds to that of FIG. 2.

Figure 4:
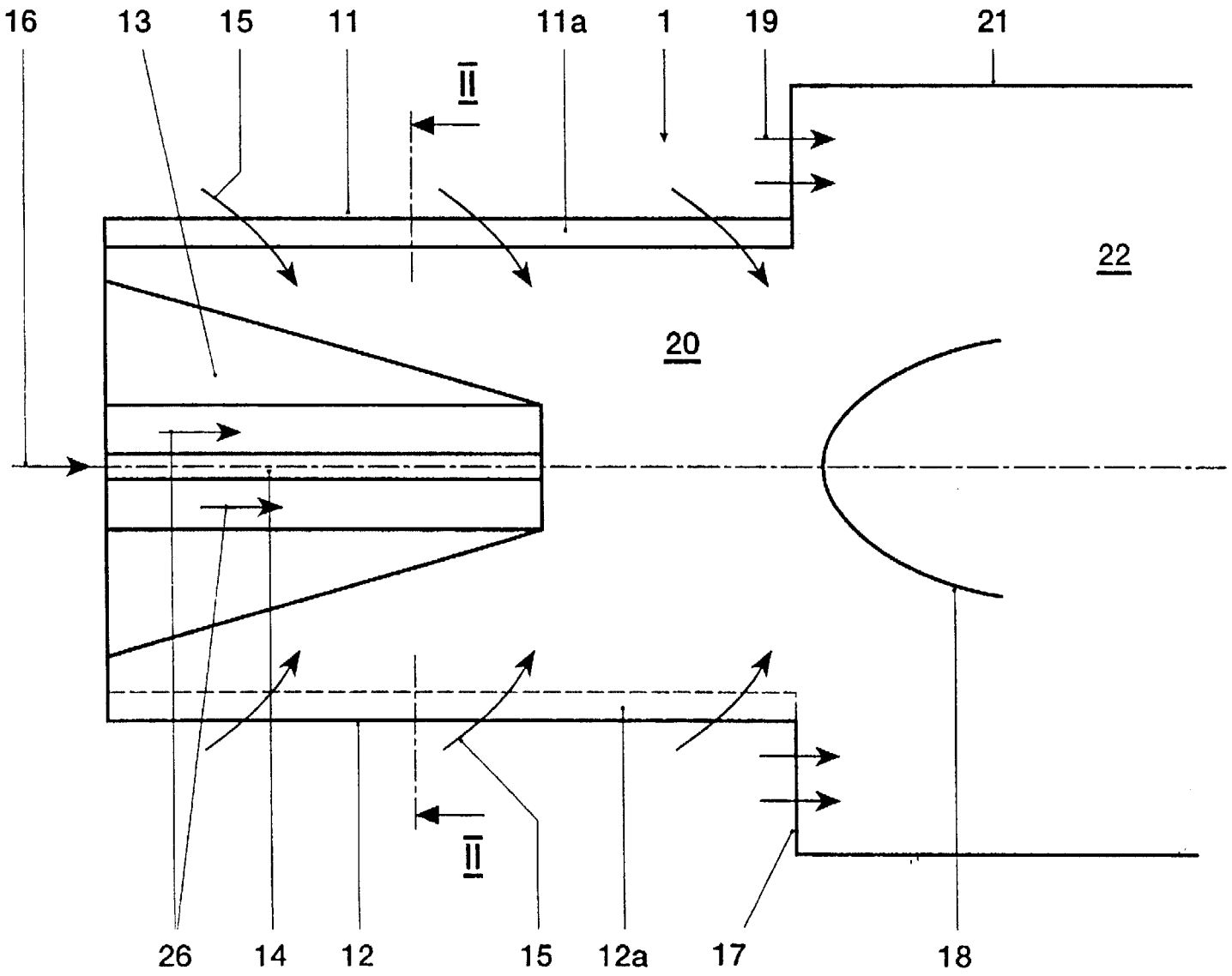
FIG. 4 shows a further premix burner essentially according to FIG. 1 but having central assisting air.

FIG. 4 largely corresponds to FIG. 1, the inner body 13 here being widened centrally with a duct for a flow of assisting air 26, which serves as a further measure for providing the critical swirl coefficient at the correct location.

As far as the number of shells is concerned, they are not restricted to two. A larger number can readily be used. If a spiral influx of the combustion mixture 15 into the interior space 20 is aimed at, this can readily be achieved via a single tangential air-inlet slot.

If the premix burner to be formed by the shells comprises a continuous tube, the tangential injections into the interior space can be achieved through duct-like leadthroughs through the wall thickness of this very same tube.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A premix burner comprising:

a casing enclosing an interior space having a longitudinally directed flow direction;

a conically shaped inner body mounted in the interior space, the inner body narrowing in the flow direction of the interior space;

the casing having at least one inlet slot extending longitudinally and positioned for a tangentially directed inflow of a combustion medium into the interior space;

a feed duct connected to guide a combustion medium into the at least one inlet slot, the feed duct having a length extending upstream of the at least one inlet slot;

means for swirling an air flow in the feed duct upstream of the at least one inlet slot; and means for introducing a fuel into the swirling air flow upstream of the at least one inlet slot a distance sufficient to allow mixing of the fuel and air before passing through the at least one inlet slot into the interior space.

2. The premix burner as claimed in claim 1, wherein the casing defines a cylindrically shaped interior space extending in the flow direction.

3. The premix burner as claimed in claim 1, wherein the the casing is shaped to define a venturi passage in the interior space.

4. The premix burner as claimed in claim 1, wherein the casing comprises at least two sectional shells nested one inside the other and mutually offset so that adjacent walls of the sectional shells define two inlet slots on opposite sides of the interior space the inlet slots extending in the longitudinal direction.

5. The premix burner as claimed in claim 1, wherein said means for swirling an air flow inside the feed duct comprises vortex generators mounted in the feed duct (11*d*, 12*d*), and wherein, said means for introducing a fuel is disposed to introduce fuel downstream of the vortex generator.

6. The premix burner as claimed in claim 1, wherein said means for swirling an air flow includes a venturi-shaped portion of the feed duct and said means for introducing a fuel is positioned for introducing fuel at a narrowest location of the venturi-shaped portion mixer (25*a*, 25*b*) formed in the feed duct.

7. The premix burner as claimed in claim 1, further comprising a combustion space arranged downstream of the interior space, the combustion space having a flow cross section larger than a flow cross section of the interior space, jump in cross-section between the interior space and combustion space being defined by a front wall, wherein a backflow zone is provided in a region of the front wall.

8. The premix burner as claimed in claim 7, wherein the front wall includes a plurality of openings for feeding an air flow into the combustion space.

9. The premix burner as claimed in claim 1, further comprising at least one fuel line disposed in the inner body for feeding at least one of a fuel and assisting air into the interior space.

10. The premix burner as claimed in claim 1, further comprising at least one swirl generator mounted at a tip of the inner body.

11. The premix burner as claimed in claim 1, wherein the case is shaped so that the at least one inlet slot has a decreasing cross-section of flow in the longitudinal direction of the premix burner.

12. The premix burner as claimed in claim 1, wherein the inner body is shaped as a diffuser.

13. The premix burner as claimed in claim 1, wherein the inner body is shaped as a confuser.

* * * * *